US005930841A

United States Patent [19]

Lampe et al.

[11] Patent Number: 5,930,841

[45] Date of Patent: Aug. 3, 1999

[54] SOCCER HEADGUARD

[75] Inventors: John K. Lampe; Robert C. Long; Kevin T. Fenton; George C. Halvorson, all of St. Paul, Minn.

[73] Assignee: Soccer Strategies/LLC, St. Paul, Minn.

[21] Appl. No.: 08/861,618

[22] Filed: May 22, 1997

Related U.S. Application Data

[60] Provisional application No. 60/041,338, Mar. 21, 1997.

[51] Int. Cl.[6] ..... A41D 20/00

[52] U.S. Cl. ..... 2/411; 2/421; 2/425; 2/DIG. 11

[58] Field of Search ..... 2/410, 411, 414, 2/417, 418, 425, 205, 421, 423, DIG. 11

[56] References Cited

U.S. PATENT DOCUMENTS

| | | | |
|---|---|---|---|
| D. 339,677 | 9/1993 | Kang . | |
| D. 370,309 | 5/1996 | Stucky . | |
| 2,969,547 | 1/1961 | Dye . | |
| 3,725,956 | 4/1973 | Reisen | 2/418 |
| 3,784,984 | 1/1974 | Aileo . | |
| 3,992,721 | 11/1976 | Morton . | |
| 4,023,209 | 5/1977 | Frieder, Jr. et al. . | |
| 4,044,400 | 8/1977 | Lewicki et al. . | |
| 4,058,854 | 11/1977 | Rhee . | |
| 4,075,717 | 2/1978 | Lemelson . | |
| 4,239,106 | 12/1980 | Aileo . | |
| 4,290,149 | 9/1981 | Aileo . | |
| 4,317,239 | 3/1982 | Bryksa . | |
| 4,345,336 | 8/1982 | Plastino . | |
| 4,354,284 | 10/1982 | Gooding . | |
| 4,398,306 | 8/1983 | Gooding . | |
| 4,404,690 | 9/1983 | Farquharson . | |
| 4,481,681 | 11/1984 | Hankin . | |
| 4,539,715 | 9/1985 | Clement . | |
| 4,581,773 | 4/1986 | Cunnane . | |
| 4,612,672 | 9/1986 | Schrack . | |
| 4,613,993 | 9/1986 | Steele et al. . | |
| 4,646,367 | 3/1987 | El Hassen . | |
| 4,698,852 | 10/1987 | Romero . | |
| 4,706,305 | 11/1987 | Cho . | |

(List continued on next page.)

FOREIGN PATENT DOCUMENTS

| | | | |
|---|---|---|---|
| 2202729 | 10/1988 | United Kingdom | 2/411 |

OTHER PUBLICATIONS

Seven photographs of "Gilbert Rugby" head protector. Date unknown.

Seven photographs of "CCC" head protector, Body Armour Ltd., New Zealand. Date unknown.

"Head and Neck Injuries in Soccer, Impact of Minor Trauma", Sports Medicine Issue No.: 14 (3) 1992, Author: Alf Thorvald Tysvaer, pp. 200–213.

"Can Sports–Minded Kids Have Too Many Helmets?", Medical News & Perspectives vol. 275, No. 18; Author: Fishbein Fellow, p. 1391, Date unknown.

*Primary Examiner*—Michael A. Neas

*Attorney, Agent, or Firm*—Merchant & Gould P.C.

[57] ABSTRACT

Generally, the present invention relates to an improved headguard for athletes and in particular soccer players. In accordance with one embodiment of the invention, a headguard is provided which includes a headcover and an adjustable head strap disposed on a perimeter of the head for drawing sections of the headcover together. The headcover includes padding having at least a front portion and a top portion and also includes a flexing section. The flexing section of the headcover is positioned such that, when the head strap is adjusted, at least a portion of the headcover flexes at the flexing section to generally conform to at least a portion of the head of a wearer.

22 Claims, 4 Drawing Sheets

U.S. PATENT DOCUMENTS 4,766,614 8/1988 Cantwell et al. .
4,768,231 9/1988 Schrack .
4,790,035 12/1988 Whyte .
4,827,537 5/1989 Villa .
4,843,642 7/1989 Brower .
4,864,662 9/1989 Frank .
4,947,488 8/1990 Ashinoff .
4,982,451 1/1991 Graham .
5,012,533 5/1991 Raffler ..... 2/420
5,042,093 8/1991 Legendre .
5,044,016 9/1991 Coombs .
5,075,903 12/1991 Richoux .
5,081,717 1/1992 Shedd et al. .
5,083,321 1/1992 Davidsson .
5,173,970 12/1992 Shifrin ..... 2/410
5,177,815 1/1993 Andujar .
5,184,354 2/1993 Alfaro et al. .
5,271,103 12/1993 Darnell ..... 2/418
5,315,718 5/1994 Barson et al. .
5,361,420 11/1994 Dobbs et al. .
5,392,468 2/1995 Leddick, III .
5,421,035 6/1995 Klose et al. .
5,437,064 8/1995 Hamaguchi ..... 2/414
5,450,631 9/1995 Egger .
5,504,945 4/1996 Purnell .
5,511,250 4/1996 Field et al. ..... 2/418
5,515,546 5/1996 Shifrin ..... 2/410
5,519,895 5/1996 Barnes, Jr. .
5,535,454 7/1996 Ryan .
5,544,367 8/1996 March, II .
5,551,094 9/1996 Navone .
5,615,419 4/1997 Williams .
5,628,071 5/1997 Nezer .
5,638,551 6/1997 Lallemand .
5,659,900 8/1997 Arney et al. .
5,661,854 9/1997 March, II .
5,680,656 10/1997 Gath .
5,701,609 12/1997 Bridges .
5,704,072 1/1998 Garneau .

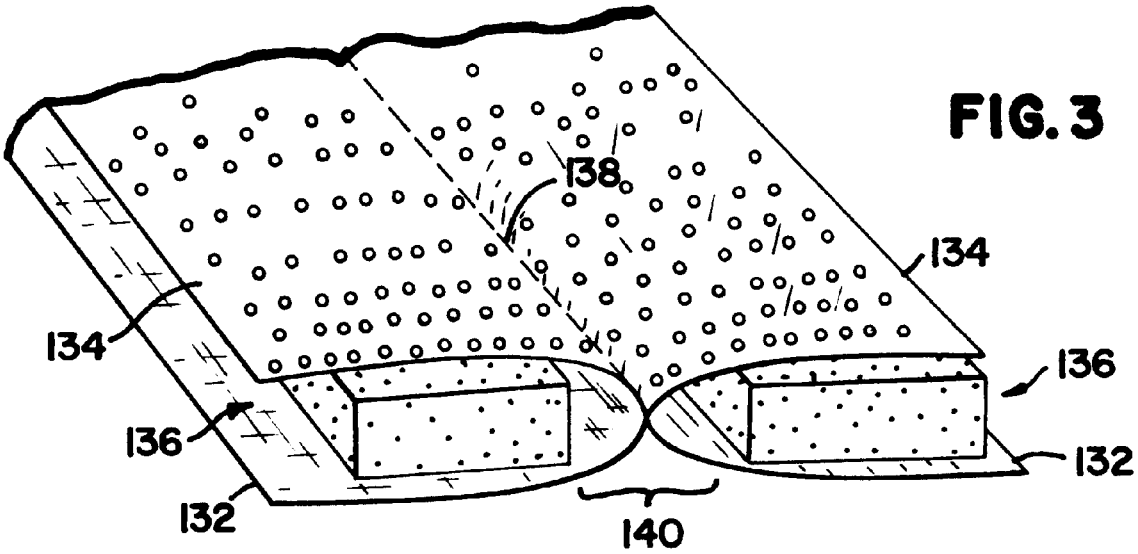
FIG. 3
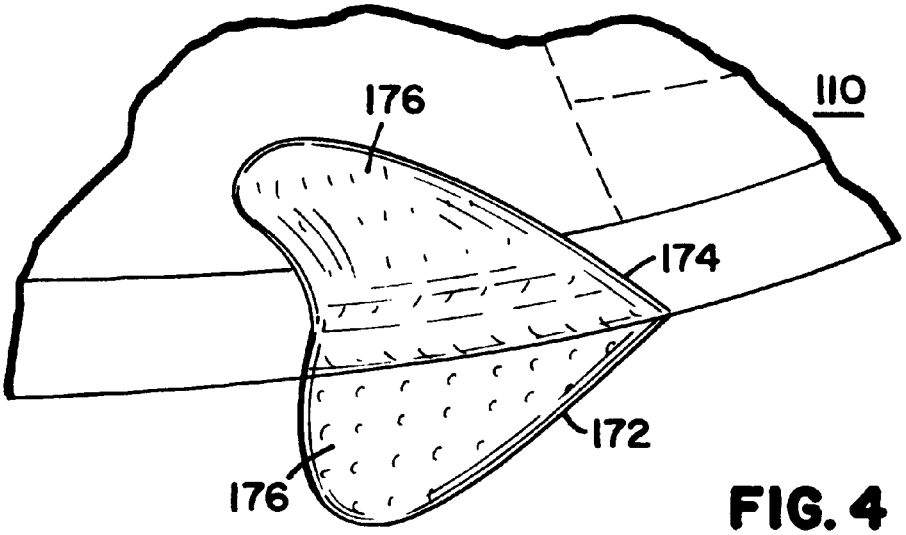
FIG. 4
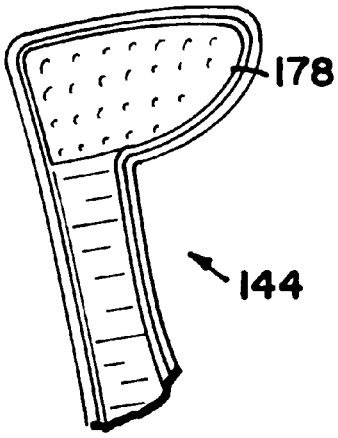

SOCCER HEADGUARD

This application claims the benefit of U.S. Provisional Application No. 60/041,338, entitled "IMPACT PROTECTIVE HEADGEAR FOR SOCCER," filed Mar. 21, 1997.

FIELD OF THE INVENTION

The present invention generally relates to protective headguards for athletics and, more particularly, relates to a protective headguard for soccer players.

BACKGROUND OF THE INVENTION

Participants in many sports are increasingly using protective headgear of various kinds. Football players have long worn helmets to protect themselves from blows to the head and face. Sometime later hockey players also began to protect themselves with helmets. More recently recreational bicyclists have perceived the need to use protective headgear and have started to wear helmets in increasing numbers.

Traditionally, soccer players have not worn any protective headgear. This is probably the case for two main reasons. First, soccer players or organizers of the game may not have sensed a need to use headgear because injuries to the head may not have seemed as commonplace as in sports such as football, hockey, and bicycling. Second, soccer is one of the few sports where the head itself is intentionally and legitimately used to strike the ball. This requires considerable muscle coordination and use of the senses of sight and touch. An improperly constructed piece of headgear could hamper a player's ability to head the ball properly.

Recent medical research has demonstrated that head injuries may be more prevalent in soccer than previously thought. Several studies have suggested that soccer players may suffer minor trauma from repeatedly heading the ball. This injury has been analogized to "pugilistic dementia," the harm that boxers suffer from repeated strikes to the head in boxing. Alf Thorvald Tysvaer, "Head and Neck Injuries in Soccer—Impact of Minor Trauma,"*Sports Medicine,* 14(3): 200–213 (1992). This danger of trauma in soccer may be greater for children. Their skills at heading are less well honed. Their bodies may not be developed enough to withstand or counteract the blow caused by a ball. Id. at 210. Therefore, at least from a safety standpoint, use of headgear by soccer players seems advisable.

The unique demands of the sport of soccer require unique headgear. Although multipurpose protective headgear for sports are being developed, most forms of headgear for use in team sports are intended for one sport and should not be used in other activities. Thomas B. Cole, "Can Sports Minded Kids Have Too Many Helmets?", *Journal of the American Medical Association,* 275(18): 1391 (May 8, 1996). A brief review of patents for headgear constructed for other sports shows how such headgear would not meet the specialized needs of soccer players. For example, football and hockey helmets are ill-suited for soccer. Their bulk would likely discourage soccer players unaccustomed to helmets from wearing them. In addition this bulk and the hard, sometimes uneven surfaces of such helmets would make it very difficult to control the direction and distance of a headed ball. Finally, other unprotected soccer players might suffer injuries caused by the hard-surfaced headgear of the wearer. See. e.g., U.S. Pat. No. 4,404,690 (hockey helmet).

Other helmets would also not work effectively as soccer headgear. Bicycle helmets are light but would make control of the ball difficult; they are built to withstand one substantial blow; and their ventilation systems would likely not be effective in soccer. See. e.g.. U.S. Pat. No. 5,450,631. Wrestling headgear protects the ears and only incidentally, if at all, protects the surfaces of the head. See, e.g., U.S. Pat. No. 5,361,420.

U.S. Pat. No. 4,698,852 illustrates protective headgear specifically designed for use in soccer. This headgear, however, has several shortcomings. The headband shape of the headgear protects only the forehead, neglecting other parts of the head which may be used, properly and improperly, to strike balls. The headband shape moreover creates a ridge at the edge of the headband which could misdirect a headed ball. In addition, the materials and retention system of this headgear likely would cause the headgear to slip up or down on the wearer's head or, if tightened, could strain the wearer's head.

SUMMARY OF THE INVENTION

Generally, the present invention relates to an improved headguard for athletes and in particular soccer players. In accordance with one embodiment of the invention, a headguard is provided which includes a headcover and an adjustable headstrap disposed on a perimeter of the head for drawing sections of the headcover together. The headcover includes padding having at least a front portion and a top portion and also includes a flexing section. The flexing section is positioned such that, when the head strap is adjusted, at least a portion of the headcover flexes at the flexing section to generally conform to at least a portion of the head of a wearer.

The padding may include a plurality of pads held within pockets formed by the headcover. For example, the headcover may include an inner layer of material and an outer layer of material joined together to define the pockets. The headcover may further include a chin strap for securing the headguard to the head of a wearer. The chin strap may, for example, be removably attached to the headcover thereby allowing the user the option of not wearing the chin strap.

The above summary of the present invention is not intended to describe each illustrated embodiment of the present invention. The figures and the detailed description which follow more particularly exemplify these embodiments.

BRIEF DESCRIPTION OF THE DRAWINGS

The invention may be more completely understood in consideration of the following detailed description of various embodiments of the invention in connection with the accompanying drawings, in which:

FIG. 3 is a cross-sectional view of the exemplary headcover;

FIG. 4 is an exploded view of an exemplary chin strap;

Figure 1:
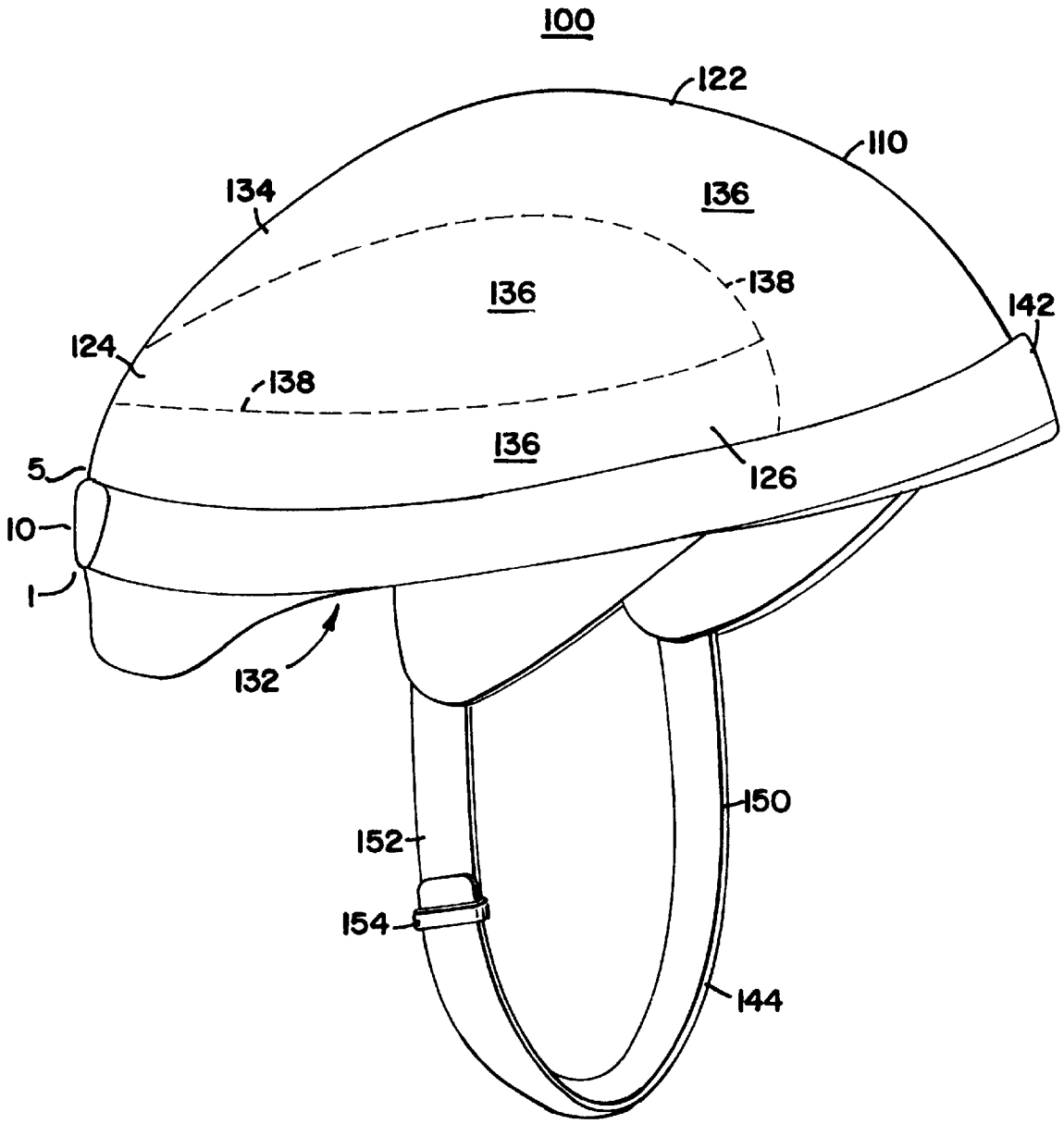
FIG. 1 is a perspective view of an exemplary headguard in accordance with one embodiment of the invention.

While the invention is amenable to various modifications and alternative forms, specifics thereof have been shown by way of example in the drawings and will be described in detail. It should be understood, however, that the intention is not to limit the invention to the particular embodiments described, although all embodiments described are intended to fall within the claims. On the contrary, the intention is to cover all modifications, equivalents, and alternatives falling within the spirit and scope of the invention as defined by the appended claims.

DETAILED DESCRIPTION OF THE DRAWINGS

The present invention is believed to be applicable to a number of different sports, and is particularly suited to soccer where players intentionally strike the ball with their head. While the present invention is not so limited, an appreciation of various aspects of the invention will be gained through a discussion of the exemplary embodiments in connection with the examples provided below.

FIG. 1 illustrates one exemplary headguard 100 in accordance with one embodiment of the invention. The headguard 100 generally includes a padded headcover 110 and one or more straps for securing the headcover to the head of a wearer. The headcover 110 generally includes padding which dissipates the force to the wearer's head when struck by an object and which is positioned on the headguard to protect the regions of the wearer's head which may strike objects during the course of play. For example, the padding may cover the front, top and side areas of a wearer's head. This particular positioning of the padding is particularly suited for soccer players, who often use these areas of the head when striking a soccer ball.

The padding is typically sufficiently flexible so as to conform to unique head shapes and sizes. The position of the padding may be suitably selected in consideration of the particular environment in which the headguard 100 is worn. For example, when used during the play of soccer, the padding may be positioned to provide a relatively uniform surface over portions of a player's head which generally come in contact with a soccer ball, thus allowing greater control of the ball.

The thickness of the padding may be suitably selected in consideration of the portion of the head on which the padding is to cover as well as in consideration of the particular environment in which the headguard 100 is worn. For example, the thickness of the padding may vary between the top, front and side portions of the padding. Pad thicknesses around, for example, ⅝ inches, would be suitable for many applications.

The padding may, further include apertures, such as channels, holes, or similar features, to circulate air through and ventilate moisture from the headcover 110. Suitable padding material includes solid and/or laminated foam, formed from plastic, for example.

Figure 2:
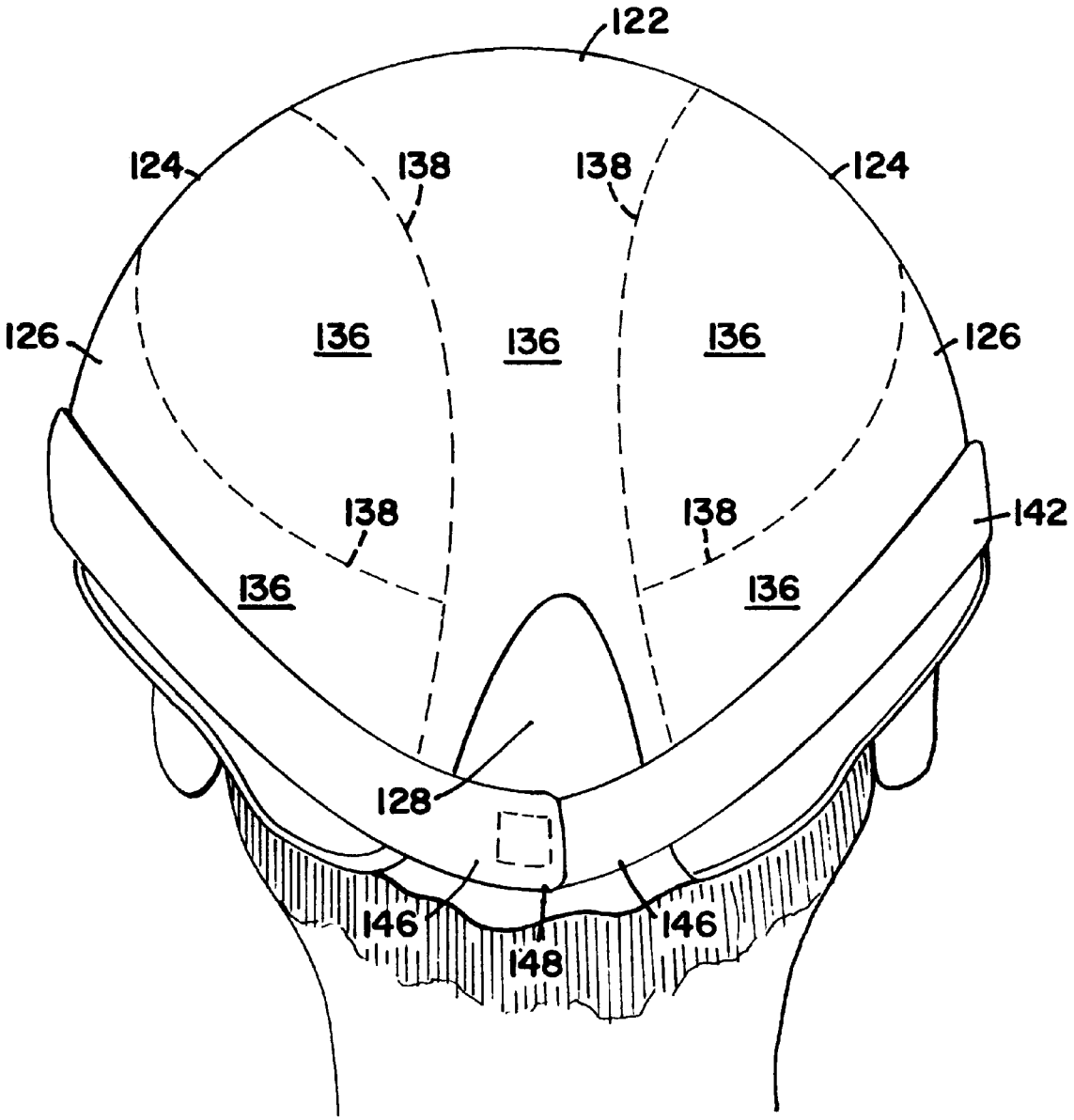
FIG. 2 is a rear view of the exemplary headguard, shown worn by a user.
Figure 5:
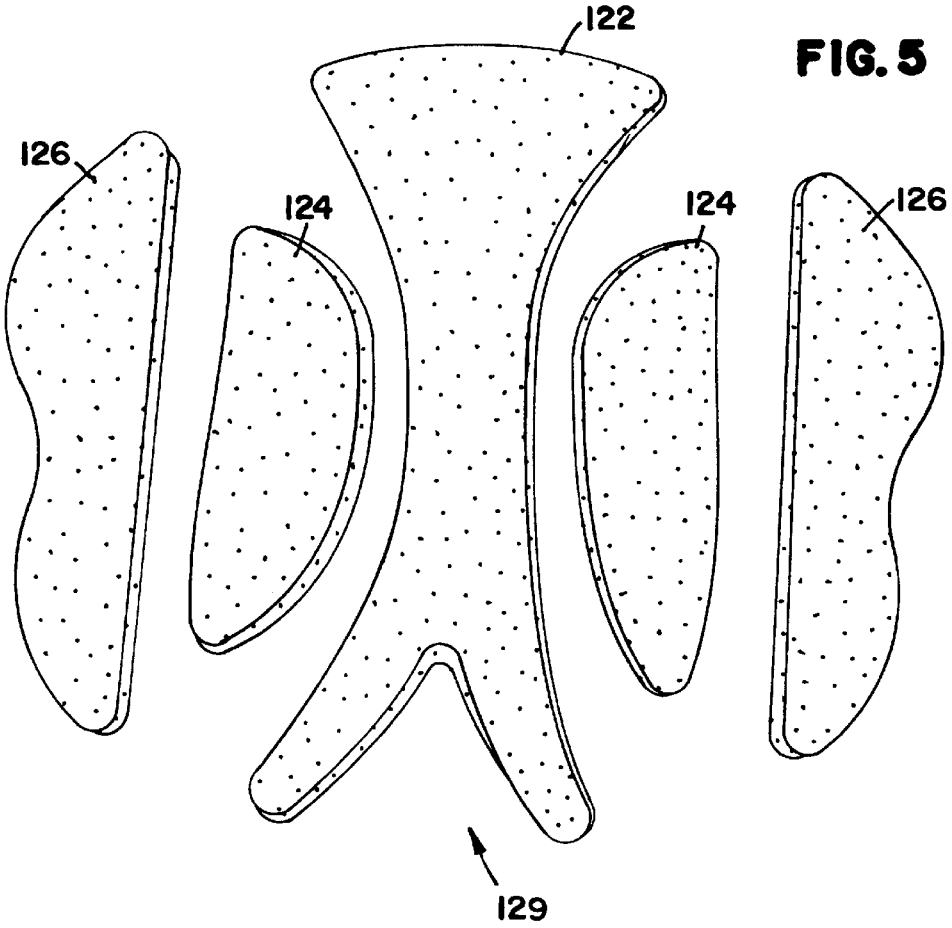
FIG. 5 illustrates an exemplary padding layout.

In the exemplary embodiment, the padding includes a central pad 122, two side pads 126, and two intermediate pads 124, as best illustrated in FIGS. 1–2 and 5. The pads 122–126, as will be discussed below, are typically held within pockets formed by the headcover 110. The central pad 122 is generally T-shaped and covers top and front areas of a head. The two side pads 126 generally cover side areas of the head and may be contoured around a wearer's ears to cover the wearer's temple and back portions of the wearer's head. The intermediate pads 124 generally cover upper side areas of the head.

The illustrated arrangement of the pads is particularly suited for soccer. The arrangement allows the pads to conform to a player's head while providing relatively uniform surfaces over areas of the head which are typically used to strike a soccer ball. The central pad 122, for example, includes a continuous surface from the forehead to a top portion of the head which facilitates heading a soccer ball by eliminating a ridge in this region. The contoured side pads 126, for example, provide a better fit and protect the temples of a wearer. The invention is however not limited to the particular pad shapes and arrangement. As noted above, the particular pad arrangement may be suitably selected depending on the environment in which the headguard is used. In alternate embodiments, for example, the pads may be designed to cover a smaller area of the head and/or more or fewer pads may be used.

As noted above, the padding is generally held in place by the headcover 110. In the exemplary embodiment, the headcover 110 is formed from an inner layer of material 132 and an outer layer of material 134, as best shown in FIGS. 1 and 3. The two layers of material are typically formed from a stretchable material and are joined together to form pockets 136 for holding the pads. As illustrated in the Figures, the pockets 136 are generally defined by seams 138 where the inner and outer layers of material 132 and 134 are joined. The inner and outer layers of material 132 and 134 may, for example, be joined by stitching, gluing, or by being integrally formed. The pockets 136 are suitably disposed about the headguard 100 to hold pads where the protection of the head is desired and may be sized to securely hold the pads 122–124 within the pockets 136 to prevent displacement of the pads 122–124 during play.

The inner and outer layers 132 and 134 may be formed from a breathable material which typically does not readily absorb moisture. The inner and outer layers 132 and 134 may, for example, include apertures for circulating air and ventilating moisture through the material. To further facilitate ventilation of the headguard 100, the pockets 136 may be configured to define gaps 140 between adjacent pads, as illustrated in FIG. 3.

The outer layer of material 134 may have a relatively tacky outer surface having, for example, a coefficient of friction greater than that of wet or moist hair or skin. Such an outer surface is particularly suited for soccer as it slows the rotation of the soccer ball when struck by the head of a player and allows more control over the direction of the ball. The outer layer of material 134 (as well as other visible portions of the headguard) may further be provided with unique colors or designs to, for example, permit the identification of teams. Suitable material for the inner and outer layers 132 and 134 includes synthetic fibers such as Lycra®, for example.

The combination of stretchable outer and inner layers of material 132 and 134 and relatively flexible padding allows the headguard 100 to conform to different head shapes and sizes. The exemplary pad shape and arrangement further facilitates such conformability. Moreover, the above-described stretchable inner and outer layers allows the pockets 136 to accommodate different sized pads. This can, for example, facilitate assembly by allowing one headcover to be universally used with a variety of pad sizes.

As noted above, the padded headcover 110 may be secured to the head using one or more adjustable straps. In the exemplary embodiment, as shown in FIG. 1, an adjustable head strap 142 and an adjustable chin strap 144 are used to secure the headguard 100 to the head. However, the invention is not so limited. In other embodiments, only one adjustable strap, for example, a head strap, is used to secure the headguard.

The head adjustment strap 142 is generally disposed on a perimeter of the headcover 110 and generally draws sections of the headcover 110 together so that the headcover 110 may better conform to the head of a wearer. The head adjustment strap 142 may be deposed about a perimeter of the headcover 110 and provide sufficient tension to securely hold the headcover 110 on the head of a wearer.

In the exemplary embodiment, the head adjustment strap 142 is disposed about the headcover 110 such that, when worn, the strap 142 typically lies on the forehead just below the frontal bone and above the brow and runs above the ears to the back of the head. The head adjustment strap 142 may be provided on the headcover 110 in a variety of manners. For example, the head adjustment strap 142 may be stitched to the outer layer of material 134, integrally formed with the headcover 110, disposed through a sleeve in the headcover 110, attached to the bottom front portion of the headcover 110, etc.

The head adjustment strap 142 may be formed of a stretchable material for securing the headguard 100 to the head with adequate and comfortable tension and stretching when the headguard 100 is pulled to protect the wearer should the headguard 100 catch on an object. The head adjustment strap 142 may further include two ends 146 connected by a fastener 148 for adjusting the tension of the strap 142. For further protection should the headguard 100 catch on an object, the fastener 148 may be of a type that breaks-away upon sufficient tension. Suitable fasteners include hook and loop fastening systems, such as Velcro®. Suitable material for the head strap 142 includes synthetic fibers, such as Lycra®.

The above-described head strap 142 further allows the headguard 100 to more readily conform to different head shapes and sizes, and also provides protection to the wearer. Moreover, the head adjustment strap can on some embodiments be used to secure the headguard 100 to the head of a wearer.

As noted above and illustrated in FIGS. 1 and 4, a chin strap 144 may be used with the head adjustment strap 142 to secure the headguard 100 to the head. The chin strap 144 may be formed from a stretchable material that provides sufficient tension under normal circumstances and that stretches to absorb forces that pull the headgear 100 in a manner that could injure the wearer. Suitable material for the chin strap includes synthetic fibers, such as Lycra®.

The chin strap 144 generally includes two separate portions 150 and 152 which are attached together using, for example, a fastener 154 such as a clasp. The chin strap 144 is generally attached to the sides of the headcover 110 so as to allow the wearer to position the chin strap 144 under his/her jaw. The chin strap 144 may be permanently attached to the sides of the headcover 110, for example, by being stitched between the inner and outer layers 132 and 134. The chin strap 144 may alternatively be removably attached to the headcover 110, as will be discussed below. In the exemplary embodiment, the chin strap portions 150 and 152 have different lengths, thereby allowing the chin strap 144 to be fastened at about mid-cheek level on one side of the head of the wearer.

As best illustrated in FIG. 4, the chin strap 144 may be removably attached to the headcover 110 to allow a user the convenience of wearing the headguard 100 with or without a chin strap. The chin strap 144 may further be attached to the headcover 110 such that the chin strap 144 releases or breaks-away from the headcover 110 when excessive forces pull the headguard 100. This further prevents injury to a wearer.

In the exemplary embodiment, each side of the headcover 110 (only one of which is shown in FIG. 4) includes two flaps 172 and 174 for attaching the chin strap 144 to the headcover 110. The inner flap 172 may be a region of the outer layer of material 134 (e.g. a region covering a temple) and the outer flap 174 may be a piece of material joined to the outer layer of material. Each of the flaps 172 and 174 generally includes fastening structure, such as an adhesive surface, for coupling with the chin strap 144. The fastening structure may be a hook and loop fastening system, such as Velcro®. In the exemplary embodiment, each of the flaps 172 and 174 include a hook or loop material 176 and the ends of the chin strap 144 include a mating hook or loop material 178 for securing the chin strap 144 between the flaps. This allows the chin strap 144 to be detached if desired. Furthermore, one of the inner and outer flaps 172 and 174 may have hook material and the other a loop material so that the flaps 172 and 174 may be attached together when the chin strap 144 is detached. This allows the fastening system to be concealed and protected. In the exemplary embodiment, the chin strap 144 breaks away at the hook and loop fastening system under sufficient stress.

The chin strap 144 cooperates with the head adjustment strap 142 to further secure the headguard 100 in a proper position on the head. By using a flexible and adjustable head strap 142 and/or chin strap 144, the headguard 100 may be worn without undue tension that might otherwise cause discomfort. In addition, by using straps which release or "break away" under sufficient tension, injuries to the head or neck can be minimized.

As illustrated in FIGS. 2 and 5, the headcover 110 may include a flexing section 128 to allow the headguard 100 to comfortably accommodate a variety of head shapes and sizes. The flexing section 128 generally expands and contracts as the head adjustment strap is adjusted so that the headcover 110 may more readily conform to a wearer's unique head shape and size. The flexing section may be formed by providing a gap in the padding. In the exemplary embodiment, for example, the flexing section 128 is formed by a gap 129 in a back portion of the central pad 122, as shown in FIG. 5. As the head adjustment strap 142 is tightened, portions of the central pad 128 defining the gap 129 may be drawn together so that the padding more readily conforms to the head. As shown in FIG. 2, the part of the headcover 110 which defines the pocket holding the central pad 122 typically spans the flexing gap 129. This part of the headcover 110 typically stretches over and is drawn together at the flexing section 128 to conform to the head. In other embodiments, the headcover 110 may define a central pad pocket which conforms to the shape of the central pad.

In use, a wearer generally slips the headcover 110 over his/her head (like one would a winter cap made of stretchable material) and pulls the stretchable headcover 110 down on all sides typically so that the front portion of the central pad 122 sits directly above the brow on the forehead. In this position, the contoured side portions 126 typically fit over the temple areas, and continue just above the ears on both sides of the head to the back of the head. The flexing section 128 generally fits over a back portion of the head or neck. The head adjustment strap 142 is then tightened and fastened at a desirable tension to hold the headgear in place on the forehead above the brow and below the protrusion on the frontal bone and on the back of the head just below the occipital bone.

Using the above-described headguard, the head of a wearer may be protected from trauma or abrasions resulting from impact with an object. As noted above, the headguard is particularly suited for soccer players, who often use their heads to strike soccer balls. The headgear may also provide protection from other injuries to the head such as unintentional contact with the ball or bodily contact with other soccer players, and striking the goal-posts or other hard surfaces.

Figure 6:
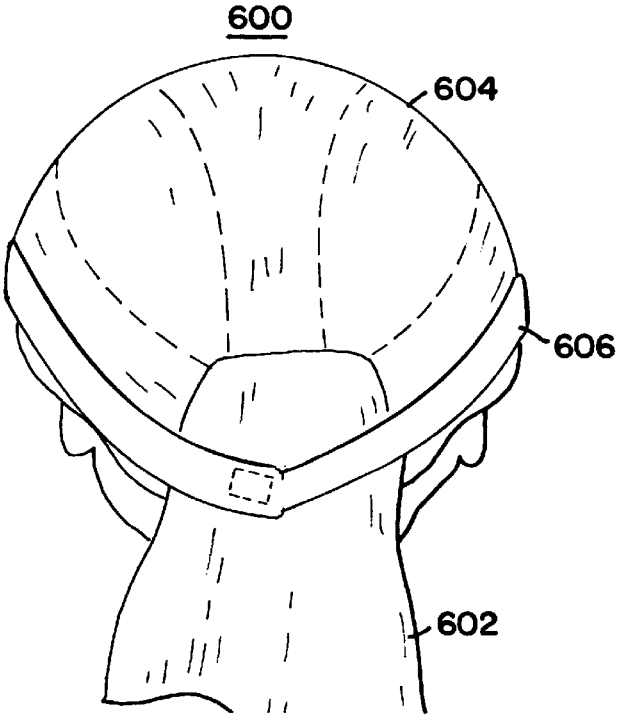
FIG. 6 is a rear view of another exemplary headguard.

FIG. 6 shows an exemplary headguard 600 having a flap 602 for covering in the neck. The flap may be removably attached to the headcover 604, for example, at a point just above the adjustment strap 606, using, for example, Velcro® or any other suitable fastener, and disposed under the adjustment strap 606 and over the neck as shown in FIG. 6. The flap 602 may be formed from a wide variety of materials including, for example, cloth. The optional neck flap advantageously cools the neck and back of head and provides protection from the sunburn. As with the headcover, the flap material may be provided with a team logo or colors.

As noted above, the present invention provides a headguard which may be used in a number of different sports in which impacts to the head may occur. The present invention should not be considered limited to the particular examples described above, but rather should be understood to cover all aspects of the invention as fairly set out in the attached claims. For example, while suitable materials, fasteners, and the like have been disclosed in the above discussion, it should be appreciated that these are provided by way of example and not of limitation as a number of other materials, fasteners, and so forth may be used without departing from the invention. Various modifications as well as numerous structures to which the present invention may be applicable will be readily apparent to those of skill in the art to which the present invention is directed upon review of the present specification. The claims are intended to cover such modifications and structures.

We claim:

1. A stretchable headguard for protecting the head of a wearer, comprising:

a stretchable headcover including a flexing section and padding, the padding having at least a front portion and a top portion;

an adjustable head strap disposed on a perimeter of the headcover for drawing sections of the headcover together; and an adjustable chin strap attached to the headcover for mounting on the chin of a wearer;

wherein the flexing section is positioned such that, when the head strap is adjusted, at least a portion of the headcover flexes at the flexing section to generally conform to at least a portion of the head;

wherein the headcover includes two sides and the chin strap includes two ends, each one of the ends being attachable to one of the two sides of the headcover;

wherein at least one of the two headcover sides includes an inner flap and an outer flap and one of the ends of the chin strap is removably attachable between the inner flap and outer flap.

2. The headguard of claim 1, wherein the inner and outer flaps may be attached together when the chin strap is unattached.

3. A stretchable headguard for protecting the head of a wearer, comprising:

a stretchable headcover including a flexing section and padding, the padding having at least a front portion and a top portion; and an adjustable head strap disposed on a perimeter of the headcover for drawing sections of the headcover together;

wherein the flexing section is positioned such that, when the head strap is adjusted, at least a portion of the headcover flexes at the flexing section to generally conform to at least a portion of the head;

wherein the padding includes a plurality of pads and the plurality of pads includes a central pad defining a gap forming the flexing section.

4. The headguard of claim 3, wherein the central pad includes the front portion and the top portion of the padding.

5. The headguard of claim 4, wherein the plurality of pads includes two contoured side pads.

6. The headguard of claim 4, wherein the plurality of pads includes two intermediate pads each disposed between one of the contoured side pads and the central pad.

7. The headguard of claim 3, wherein the headcover defines a plurality of stretchable pockets for holding the pads.

8. The headguard of claim 7, wherein the headcover includes a stretchable inner layer of material and a stretchable outer layer of material joined together to form the stretchable pockets.

9. The headguard of claim 8, wherein the plurality of pads are disposed to form one or more gaps between adjacent pads, the inner and outer layers of material being breathable so as to ventilate air through the gaps.

10. The headguard of claim 8, wherein the inner and outer layers of material and the padding each include apertures for ventilating the head.

11. A stretchable headguard for protecting the head of a wearer comprising:

a stretchable headcover including a flexing section and padding, the padding having at least a front portion and a top portion; and an adjustable head strap disposed on a perimeter of the headcover for drawing sections of the headcover together;

wherein the flexing section is positioned such that, when the head strap is adjusted, at least a portion of the headcover flexes at the flexing section to generally conform to at least a portion of the head;

wherein the adjustable headstrap encircles an entire perimeter of the headcover.

12. The headguard of claim 11, wherein the adjustable head strap is disposed on the perimeter of the headcover so that the head strap may be positioned around the head of a wearer, below the occipital bone of the wearer and between the frontal bone and the brow of the wearer, when the headguard is worn.

13. The headguard of claim 11, wherein the headcover includes a tacky outer surface relative to wet skin or hair.

14. The headguard of claim 11, further including a loose neck flap extending downward from the headcover for covering the neck of a wearer when the headguard is worn.

15. The headguard of claim 11, wherein the headstrap is disposed on an outer surface of the headcover.

16. A headguard for protecting the head of a wearer, comprising:

a stretchable headcover including an inner layer of material and an outer layer of material joined together to form a plurality of pockets;

a plurality of pads, each one of the pads being held within one of the pockets, the plurality of pads including a flexing section; and an adjustable head strap disposed on a perimeter of the headcover for drawing sections of the headcover together;

wherein the flexing section is positioned such that, when the head strap is adjusted, at least a portion of the headcover flexes at the flexing section to conform to at least a portion of the head;

wherein the stretchable headcover includes an inner flap and an outer flap, one of the inner flap and outer flap including a hook surface and the other of the inner flap and outer flap including a loop surface which attaches to the hook surface such that the inner and outer flaps may be detachably coupled; and wherein the headguard further includes a chin strap having a hook surface on one side and a loop surface on another side, the hook and loop surfaces of the chin strap being capable of attaching to the hook and loop surfaces of the inner and outer flaps such that the chin strap may be detachably coupled between the inner and outer flaps of the stretchable headcover.

17. The headguard of claim 16, wherein the adjustable headstrap encircles an entire perimeter of the headcover.

18. The headguard of claim 16, wherein one of the pads defines a gap which defines the flexing section, the gap being spanned by part of the stretchable headcover.

19. The headguard of claim 16, wherein the plurality of pads includes a central pad having a rear portion defining the flexing section, a top portion for covering a top portion of the head, and a front portion, extending laterally from and wider than the top portion, for covering a portion of a forehead of the head.

20. A protective headguard for protecting the head of a wearer, comprising:

a flexible padded headcover; and an adjustable head strap disposed on the headcover for drawing portions of the headcover together so that the headcover generally conforms to at least a portion of the head;

wherein the adjustable head strap encircles an entire perimeter of the headcover;

wherein the headcover includes two sides each having an inner flap and an outer flap and the headguard further includes a removable chin strap attachable between the inner flap and outer flap of each side.

21. A protective headguard for protecting the head of a wearer, comprising:

a flexible, padded headcover; and an adjustable head strap disposed on the headcover for drawing portions of the headcover together so that the headcover generally conforms to at least a portion of the head;

wherein the headcover includes two sides each having an inner flap and an outer flap and the headguard further includes a removable chin strap attachable between the inner flap and outer flap of each side.

22. The headguard of claim 21, wherein the inner flap and outer flap of each side may be attached when the chin strap is removed.

* * * * *